US005308070A

United States Patent [19]

Whittaker

[11] Patent Number: 5,308,070

[45] Date of Patent: May 3, 1994

[54] GOLF PUTT PRACTICE DEVICE

[76] Inventor: Richard E. Whittaker, RD #8 - Box 562, Leawood Dr., New Castle, Pa. 16105

[21] Appl. No.: 946,562

[22] Filed: Sep. 18, 1992

[51] Int. Cl.[5] ..... A63B 69/36

[52] U.S. Cl. ..... 273/186.1; 273/192

[58] Field of Search ..... 273/192, 187 R, 191 R, 273/191 A, 191 B, 186.1

[56] References Cited

U.S. PATENT DOCUMENTS

| | | | |
|---|---|---|---|
| 2,084,901 | 6/1937 | Eisenberg | 273/192 |
| 2,303,736 | 12/1942 | Hall | 273/192 X |
| 2,340,793 | 2/1944 | Chapman | 273/192 |
| 2,858,133 | 10/1958 | Self | 273/192 X |
| 3,166,326 | 1/1965 | Mundy | 273/192 X |
| 3,343,842 | 9/1967 | Woerner | 273/192 |
| 3,844,569 | 10/1974 | Swanson | 273/192 |
| 4,095,797 | 6/1978 | Breese | 273/187 R X |
| 4,322,084 | 3/1982 | Reece et al. | 273/192 X |
| 4,437,669 | 3/1984 | Pelz | 273/186 C |
| 4,620,708 | 11/1986 | Meyer | 273/192 |
| 4,699,384 | 10/1987 | Bechler et al. | 273/186.1 |
| 4,718,674 | 1/1988 | Henry | 273/186.1 |

*Primary Examiner*—George J. Marlo

*Attorney, Agent, or Firm*—Harpman & Harpman

[57] ABSTRACT

A portable golf putt practice device for guiding a golfer to putt a golf ball toward a hole aids the golfer in swinging the putter along a straight line and hitting the ball along a desired path to the hole. Additionally, the golf putt practice device guides and conditions the golfer with respect to the putter and its movement and elevation along the device and is so formed that the improper elevation of the putter engages a portion of the device to emphasize the incorrect elevation and/or position of the putter immediately prior to hitting a golf ball adjacent thereto. The golf putt practice device comprises a lightweight relatively small portable device consisting of an elongated straight cross-sectionally round rod and a pair of shorter cross sectionally round rods positioned transversely of one end of the elongated rod and secured to said one end thereof in slightly elevated relation to the upper surface of the elongated rod. If the head of the putter is too low for proper engagement with a golf ball when the head is slid along the straight elongated rod during a putting stroke, the slightly raised transversely positioned pair of rods will provide a small bump which is telegraphed to the golfer's hands to indicate the undesirable non-elevated soled position of the putter head.

5 Claims, 1 Drawing Sheet

GOLF PUTT PRACTICE DEVICE

BACKGROUND OF THE INVENTION

1. Technical Field

This invention relates to golf putting training apparatus and devices that guide and train a golfer in achieving a desirable golf putting stroke with a putter so as to achieve a straight line properly elevated putter position with respect to its engagement with a golf ball.

2. Description of the Prior Art

Prior apparatus and devices of this type have employed track-like guides in which a putter and/or its shaft are engaged in a device movable along a track or similar guide such as in U.S. Pat. Nos. 2,084,901 to Eisenberg and 2,203,736 to Hall.

Other training devices in which a putter head or its shaft is provided with guiding members or tracks are disclosed in U.S. Pat. Nos. 3,343,842 to Woerner, 4,437,669 to Pelz, and 4,620,708 to Meyer, et al.

In the Eisenberg patent, parallel spaced arcuate tracks movably position a carriage in which a putter head and shaft are positioned. In the Hall patent, an elongated bar has a spool-like member slidable therealong to form parallel flanges between which the shaft of a putter is positioned. The Woerner patent provides an elongated transversely flat guide bar 10 having a straight edge 12 and means for supporting the same in elevated relation to the supporting surface. A putter shaft is moved along the straight edge of the bar to guide the putter. The Pelz patent has a pair of parallel arcuate guides between which the head of a putter is positioned for movement relative thereto and the Meyer, et al. patent has a pair of parallel straight guide rails and a pair of spaced flexible cords extending outwardly from the ends thereof to form a guide for the head of a putter.

SUMMARY OF THE INVENTION

A golf putt practice device comprises an elongated preferably cross sectionally round rod and a pair of shorter, preferably cross sectionally round rods, secured to one another and to a first end of the elongated rod in slightly elevated relation thereto to form an essentially T-shaped device which is laid on the green in spaced relation to the hole therein with the elongated rod positioned on a target line for the golf ball to the hole and with the transversely positioned slightly elevated rods on the first end thereof immediately adjacent the golf ball to be hit toward the hole. The device therefore forms a straight target line that a golfer can follow with the head of the putter to hit the ball in the desired direction and the height of the elongated straight rod provides a height gauge for the golfer who can slide the head of the putter along the elongated straight rod or move it slightly thereabove and if the head of the putter is too low for proper engagement with the ball, the slightly raised transversely positioned pair of rods will provide a small bump which is telegraphed to the golfer's hands to indicate the undesirable non-elevated soled position of the putter head. Practice with the device has been shown to permit the golfer to assume his preferred stance and at the same time automatically correct the putting stroke with respect to the direction and height above the ground of the putter to achieve a more accurate putting hit with respect to the golf ball.

DESCRIPTION OF THE PREFERRED EMBODIMENT

Figure 1:
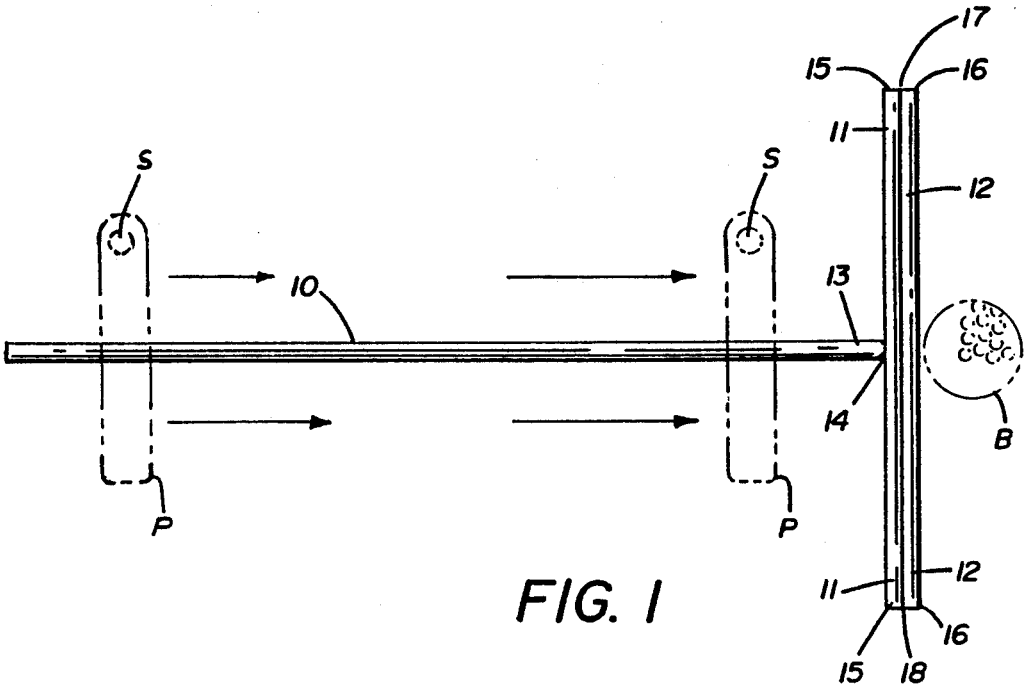
FIG. 1 is a top plan view of the golf putt practice device with broken line illustrations of a putter and a golf ball.
Figure 2:
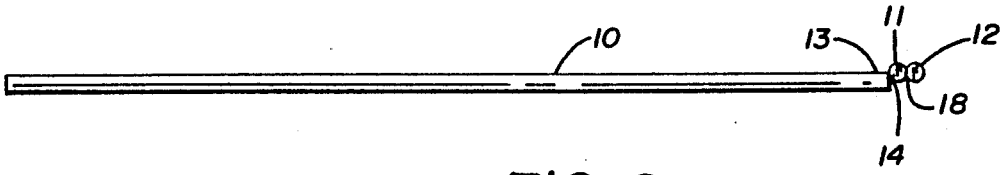
FIG. 2 is a side view of the device of FIG. 1.

In its simplest form, the golf putt practice device as seen in FIG. 1 is comprised of an elongated straight rod 10 of a length that will enable the putter to travel on or above the elongated straight rod 10 throughout the critical length of its stroke toward the golf ball B. A pair of shorter straight rods 11 and 12 are positioned transversely of an end 13 of the elongated rod 10 and secured thereto by a weld 14. The rods 11 and 12 are positioned in elevated relation to the end 13 of the rod 10 as seen in FIG. 2 of the drawings to form a bump that will be engaged by the putter if the same is sliding on the elongated straight rod 10 and thus in a soled position (on the ground) slightly below a preferred position slightly thereabove. The pair of shorter rods 11 and 12 are preferably fastened to one another at their ends 15 and 16 respectively by welds 17 and 18 respectively.

It will occur to those skilled in the art that while the elongated straight rod 10 and the pair of transversely positioned straight rods 11 and 12 are cross sectionally round, alternate cross sectional shapes may be substituted and if desired the pair of shorter straight rods 11 and 12 may be formed as a unitary member. In such alternative forms, rounded or slightly rounded uppermost surfaces are desirable both with respect to frictional engagement of the putter if it is slid along the rod 10 and in the case of the shorter transverse rods 11 and 12, the upper rounded surface of the rod 12 provides a second bump indication if the putter is in too low a position when it engages the shorter rods 11 and 12.

By referring again to FIG. 1 of the drawings, it will be seen that two broken line outlines of a putter head P are illustrated as are putter shafts S and that a golf ball is indicated in broken lines as B. Arrows in FIG. 1 between the two outlines of the putter head and parallel with the elongated straight rod 10 indicate the full travel motion of the putter P toward the end 13 of the elongated rod 10 and the bump formed by the slightly elevated transversely positioned rods 11 and 12. The length of the travel of the putter varies depending on the distance between the golf ball and the hole.

It will also be seen that the transverse positioning of the rods 11 and 12 with respect to the end 13 of the elongated rod 10 provides a visual comparison of the front surface of the putter P with respect thereto which is in addition to its visual right angular comparison with the elongated straight rod 10, both of which enable the putter to be presented to the ball in a desirable position to insure a straight target line of the ball as an extension of the longitudinal direction of the elongated straight rod 10.

Figure 3:
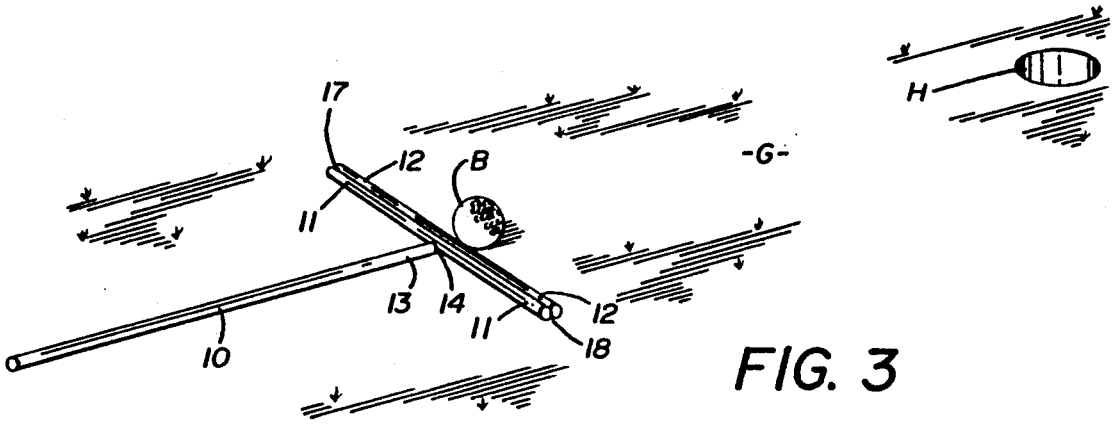
FIG. 3 is a perspective view of the device on a green spaced with respect to a hole with a golf ball positioned immediately adjacent the device.

By referring now to FIG. 3 of the drawings, a portion of a green G may be seen along with a hole H therein and providing a perspective elevation of the golf putt practice device of the invention. In FIG. 3, it will be seen that the golf ball B is positioned close to the outer surface of the transverse rod 12 and on a target line extending longitudinally and axially from the end 13 of the elongated straight rod 10 which provides a straight line to the hole H.

The golf putting practice device is preferably formed of metal or other material having a weight suitable for positioning the same on the green or other putting practice surface so as to be capable of retaining its position when engaged by the putter.

For example, the straight rods 10, 11 and 12 may be formed of quarter-inch steel rods, such as stainless or plated, and the transversely positioned rods 11 and 12 are elevated approximately one-half the diameter of the steel rods as illustrated in FIG. 2 of the drawings.

Although but one embodiment of the present invention has been illustrated and described, it will be apparent to those skilled in the art that various changes and modifications may be made therein without departing from the spirit of the invention or from the scope of the appended claims.

Having thus described my invention, what I claim is:

1. A portable device for training a golfer to putt a ball along a target line comprising an elongated straight body member of a length corresponding to that used in exercising a putting stroke therealong and having an upper surface and a shorter body member having a pair of parallel upper surfaces positioned transversely on one end of said elongated body member and elevated with respect to the upper surface of the same and secured thereto, the elevated distance of said shorter body being such as to permit a golf putter head striking face to hit a golf ball positioned on a horizontal surface adjacent said shorter body and in alignment with said elongated member when said device and ball are resting on a horizontal surface and said putter head is stroked horizontally along said elongated member and above said shorter body.

2. The device of claim 1 wherein said elongated body member is a straight rod and the shorter body member positioned transversely on one end of said elongated straight body member and affixed to one end of said elongated straight body member comprises a pair of straight rods secured to one another.

3. The device of claim 1 wherein the elongated straight body member is a straight rod of cross sectional round shape and the shorter body member are straight rods of cross sectional round shape whereby the upper surfaces of said body members are transversely convex.

4. A portable device for training a golfer to putt a ball along a target line comprising an elongated straight cross sectionally round metal rod and a pair of shorter cross sectionally round metal rods positioned transversely of one end of said elongated metal rod and elevated with respect to the same and welded thereto so as to form a raised surface and so that a distinct bump results when a putter engages said rods, the elevated distance of said shorter body being such as to permit a golf putter head striking face to hit a golf ball positioned on a horizontal surface adjacent said shorter body and in alignment with said elongated member when said device and ball are resting on a horizontal surface and said putter head is stroked horizontally along said elongated member and above said shorter body.

5. The device of claim 4 wherein the elongated metal rod and the pair of transversely positioned metal rods are of a known diameter and the pair of shorter metal rods are raised above said elongated metal rod a distance approximately one-half said known diameter of said rods so as to form a bump when engaged by a putter moving along said elongated rod.

* * * * *